US011186919B2

(12) United States Patent
Hosokawa

(10) Patent No.: US 11,186,919 B2
(45) Date of Patent: Nov. 30, 2021

(54) PLATING APPARATUS AND PLATING METHOD

(71) Applicant: Murata Manufacturing Co., Ltd., Nagaokakyo (JP)

(72) Inventor: Takao Hosokawa, Nagaokakyo (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 0 days.

(21) Appl. No.: 16/886,837

(22) Filed: May 29, 2020

(65) Prior Publication Data

US 2020/0392636 A1 Dec. 17, 2020

(30) Foreign Application Priority Data

Jun. 13, 2019 (JP) ..... JP2019-110600

(51) Int. Cl.
*C25D 17/16* (2006.01)
*C25D 5/08* (2006.01)
*C25D 21/14* (2006.01)

(52) U.S. Cl.
CPC ..... *C25D 5/08* (2013.01); *C25D 17/16* (2013.01); *C25D 21/14* (2013.01)

(58) Field of Classification Search
None
See application file for complete search history.

(56) References Cited

U.S. PATENT DOCUMENTS

2019/0112728 A1 4/2019 Hosokawa

FOREIGN PATENT DOCUMENTS

| | | | | |
|---|---|---|---|---|
| EP | 0584096 | * | 1/1996 | ..... C25D 21/14 |
| EP | 1063322 | * | 12/2000 | ..... C25D 1/04 |
| JP | 10-212596 A | | 8/1998 | |
| WO | 2017/217216 A | | 12/2017 | |

OTHER PUBLICATIONS

English translation of WO 2017/217216, Dec. 21, 2017. (Year: 2017).*

* cited by examiner

*Primary Examiner* — Stefanie S Wittenberg
(74) *Attorney, Agent, or Firm* — Keating & Bennett, LLP

(57) ABSTRACT

A plating apparatus includes a plating tank and a plating unit. The plating unit includes a partition wall allowing the plating solution to pass through but not allowing the plating object to pass through, and defines inside thereof a plating object passage through which the plating object passes, an injector which injects the plating solution upward, a mixing portion in which the plating solution and the plating object are mixed, an anode outside the plating object passage, a cathode inside the plating object passage with a hollow region through which a fluid mixture of the plating solution and the plating object passes upward, a first shielding wall which guides the fluid mixture downward, and a second shielding wall outside the first shielding wall. A lower end of the first shielding wall is lower than an upper end of the second shielding wall.

11 Claims, 10 Drawing Sheets

PLATING APPARATUS AND PLATING METHOD

CROSS REFERENCE TO RELATED APPLICATIONS

This application claims the benefit of priority to Japanese Patent Application No. 2019-110600 filed on Jun. 13, 2019. The entire contents of this application are hereby incorporated herein by reference.

BACKGROUND OF THE INVENTION

1. Field of the Invention

The present invention relates to a plating apparatus and a plating method.

2. Description of the Related Art

For example, in order to prevent the solder erosion or improve the mounting reliability in soldering an electronic component such as a chip-type multilayer capacitor, it is a common practice to perform Ni plating or Sn plating on the surface of external electrodes provided in the electronic component.

To perform Ni plating, Sn plating or the like on such an electronic component, a barrel plating method disclosed in Japanese Patent Laying-Open No. 10-212596 is often used.

According to the barrel plating method, a cathode is disposed inside the barrel in contact with the plating objects so that the plating objects serve as the negative electrode, and an anode is disposed outside the barrel and is immersed in the plating solution as the positive electrode, and then a current is applied to both electrodes so as to perform the plating on the plating objects.

However, in the barrel plating method, the current density distribution in the barrel is highly uneven, and thus the thickness of a film to be plated varies greatly.

In contrast, WO 2017/217216 discloses a plating apparatus configured to perform an electrolytic plating on a plating object while the plating object is being guided to pass through a plating object passage sandwiched between an anode and a cathode.

FIG. 10 is a front sectional view illustrating the configuration of a plating apparatus 200 described in WO 2017/217216. In the plating apparatus 200, the plating object is plated by the following steps (a) to (c):

(a) guiding a fluid mixture 203 of a plating solution 201 and a plating object 202 into a plating object passage 205 that is at least partially surrounded by a partition wall 204 that allows the plating solution 201 to pass through but does not allow the plating object 202 to pass through;

(b) performing an electrolytic plating on the plating object 202 by applying a voltage between an anode 206 which is disposed outside the plating object passage 205 and a cathode 207 which is disposed inside the plating object passage 205 while the plating object 202 is being guided to pass through the plating object passage 205 downward; and (c) injecting the plating solution 201 from a position below the cathode 207 upward so as to mix the injected plating solution 201 and the plating object 202 that has passed through the plating object passage 205 and force the fluid mixture 203 of the plating solution 201 and the plating object 202 to pass through a hollow region 208 provided inside the cathode 207 upward.

In the step (c), a portion of the plating solution 201 of the fluid mixture 203 that has passed through the hollow region 208 upward flows through a plating solution passage 209 that allows the plating solution 201 to pass through but does not allow the plating object 202 to pass through to the outside. The plating object 202 contained in the fluid mixture 203 precipitates by its own weight.

The plating apparatus 200 may perform satisfactory plating at a stable current density, and may suppress the thickness variation of the plated film.

However, it was discovered that in the plating apparatus 200 described in WO 2017/217216, in addition to the current flowing between a portion of the anode 206 and a portion of the cathode 207 facing each other, a current may flow through a path from the anode 206 to the cathode 207 via the plating solution 201 flowing through the plating solution passage 209. Since the plating object 202 contained in the fluid mixture 203 that has passed through the hollow region 208 upward is not in electrical conduction with the cathode 207, the plating object 202 in the current path described above may be subjected to a bipolar phenomenon, which cause a conductive portion thereof to undergo polarization, leading to oxidative dissolution.

SUMMARY OF THE INVENTION

Preferred embodiments of the present invention provide plating apparatuses and plating methods that are each capable of preventing a bipolar phenomenon from occurring.

A plating apparatus according to a preferred embodiment of the present invention includes a plating tank which stores a plating solution; and a plating unit which is disposed inside the plating tank and performs an electrolytic plating on a plating object; the plating unit includes a partition wall which allows the plating solution to pass through but does not allow the plating object to pass through, and defines inside thereof a plating object passage through which the plating object passes downward; an injector which injects the plating solution upward; a mixing portion which is provided above the injector and below the plating object passage and in which the plating solution injected by the injector and the plating object that has passed through the plating object passage are mixed; an anode which is disposed outside the plating object passage; a cathode which is disposed inside the plating object passage and is provided with a hollow region through which a fluid mixture of the plating solution and the plating object mixed in the mixing portion passes upward; a first shielding wall which is disposed above the cathode and outside the cathode when viewed in an extending direction of the plating object passage to guide the fluid mixture to pass through the hollow region downward; and a second shielding wall which is disposed outside the first shielding wall, wherein a lower end of the first shielding wall is located lower than an upper end of the second shielding wall.

The upper end of the second shielding wall may be located higher than the liquid level of the plating solution.

The plating apparatus may further include a fluid guide which guides the fluid mixture that has passed upward through the hollow region of the cathode to the outside when colliding with the same.

The fluid guide may be disposed above the cathode.

The upper end of the anode may be located lower than the liquid level of the plating solution, and the plating apparatus may further include an insulator disposed above the anode so as to cover the anode when viewed from the above.

The upper end of the anode may be located higher than the liquid level of the plating solution, and a portion of the anode that is higher than a region where the plating object is plated may be covered with an insulator.

The diameter of an injection port of the injector may be smaller than the inner diameter of the cathode.

The diameter of the injection port of the injector may be about 60% or more of the inner diameter of the cathode.

A plating method according to a preferred embodiment of the present invention includes guiding a fluid mixture of a plating solution and a plating object into a plating object passage that is at least partially surrounded by a partition wall which allows the plating solution to pass through but does not allow the plating object to pass through; performing an electrolytic plating on the plating object by applying a voltage between an anode which is disposed outside the plating object passage and a cathode which is disposed inside the plating object passage while the plating object is being guided to pass through the plating object passage downward; injecting the plating solution from a position below the cathode upward so as to mix the injected plating solution and the plating object that has passed through the plating object passage and force the fluid mixture of the plating solution and the plating object to pass through a hollow region provided inside the cathode upward; guiding the fluid mixture that has passed through the hollow region downward along a first shielding wall which is disposed above the cathode and outside the cathode when viewed in an extending direction of the plating object passage; and guiding at least a portion of the plating solution in the fluid mixture that has been guided downward along the first shielding wall upward along a second shielding wall which is disposed outside the first shielding wall to flow out of an upper end of the second shielding wall.

According to preferred embodiments of the present invention, it is possible to reduce the current flowing from the upper side of the anode to the cathode so as to prevent the bipolar phenomenon from occurring. The reasons thereof will be described hereinafter.

Specifically, the fluid mixture of the plating object and the plating solution that has passed upward through the hollow region is guided downward along the first shielding wall. In the fluid mixture, the plating object with a high specific gravity precipitates and accumulates, but at least a portion of the plating solution is blocked from flowing downward by the accumulated plating object, and thus, it flows along the second shielding wall which is disposed outside the first shielding wall to flow out of the upper end of the second shielding wall. Thus, as compared with the conventional plating apparatus in which the plating solution flows through the plating solution passage to the outside, the plating apparatuses according to preferred embodiments of the present invention may each reduce the current flowing from the upper side of the anode to the cathode and prevent the bipolar phenomenon from occurring. Thus, it is possible to prevent a conductive portion of the plating object from undergoing oxidative dissolution, and therefore prevent the reliability of the plating object from being reduced.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

The features of the present invention will be described in detail with reference to the following preferred embodiments of the present invention and the drawings.

In the following preferred embodiments, as an example, a multilayer ceramic capacitor, which is a typical chip electronic component, is used as a plating object, and external electrodes provided on the surface of the multilayer ceramic capacitor are electrolytically plated by a plating apparatus. However, the plating object is not limited to the multilayer ceramic capacitor.

First Preferred Embodiment

Figure 1:
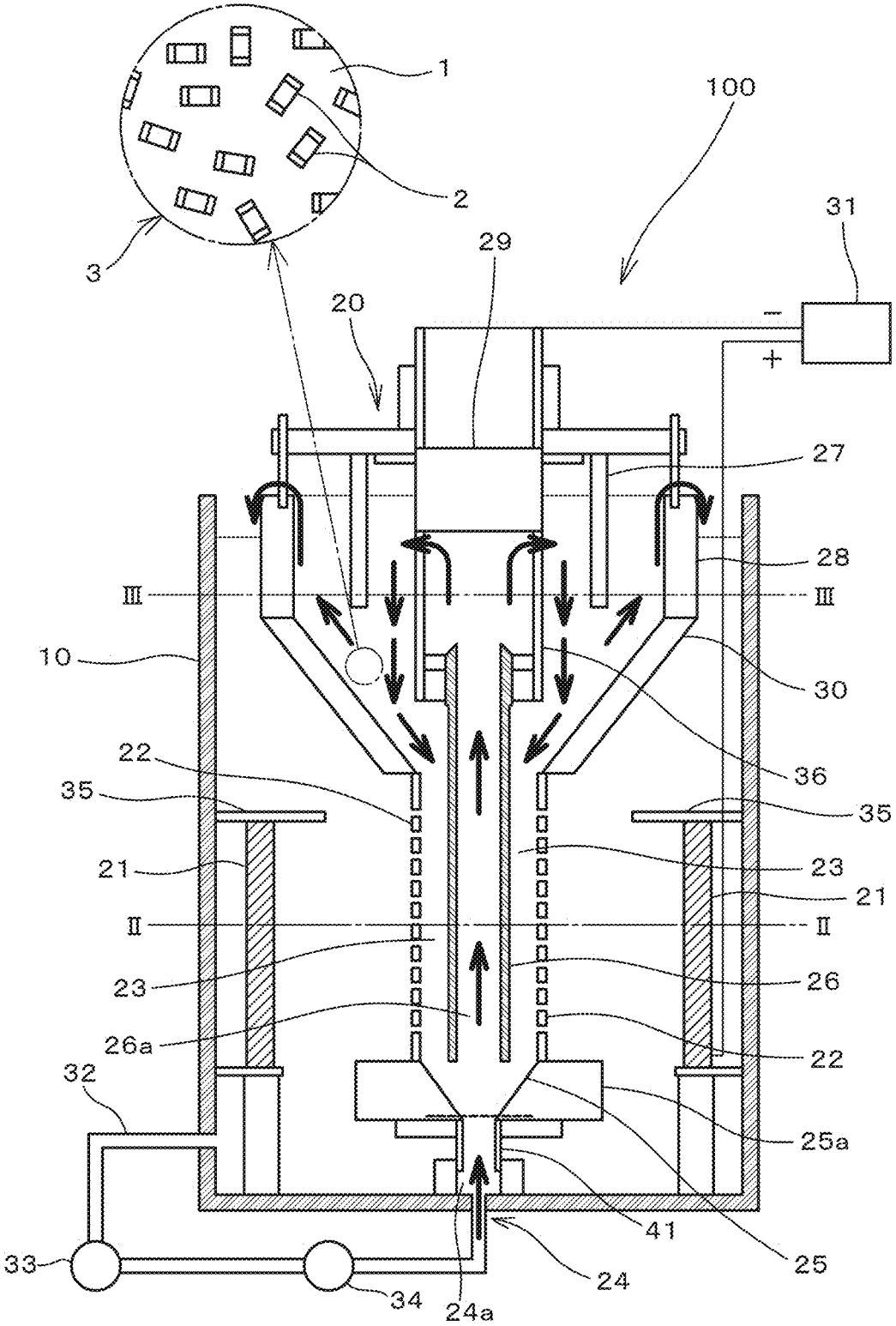
FIG. 1 is a front sectional view illustrating a plating apparatus according to a first preferred embodiment of the present invention.
Figure 2:
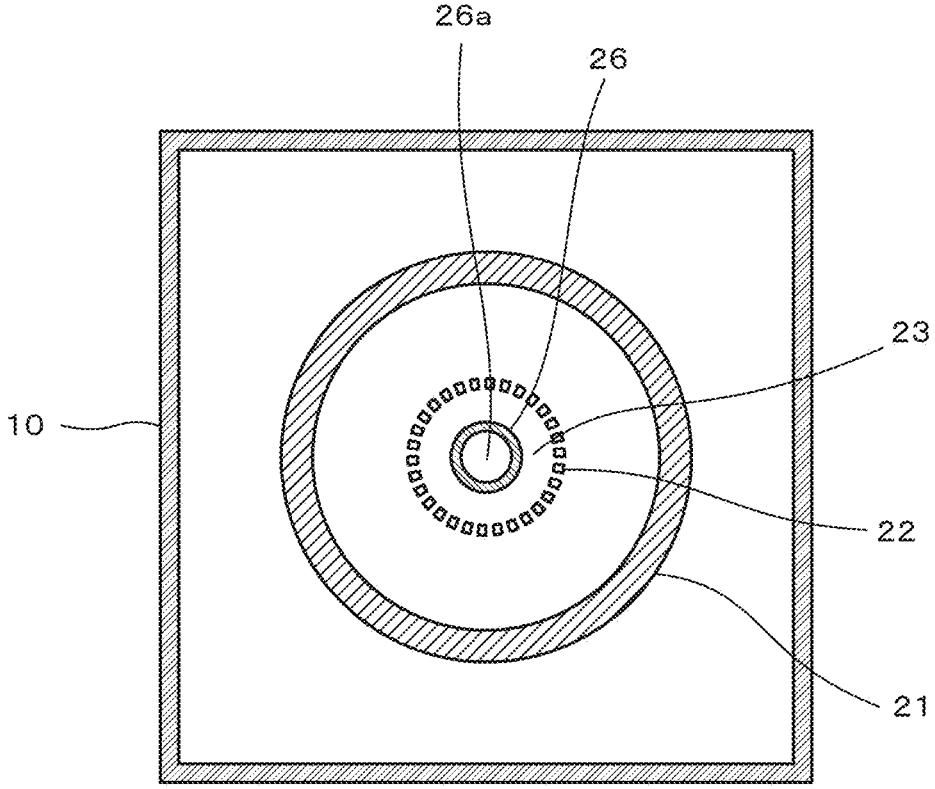
FIG. 2 is a cross-sectional view taken along line II-II of FIG. 1.
Figure 3:
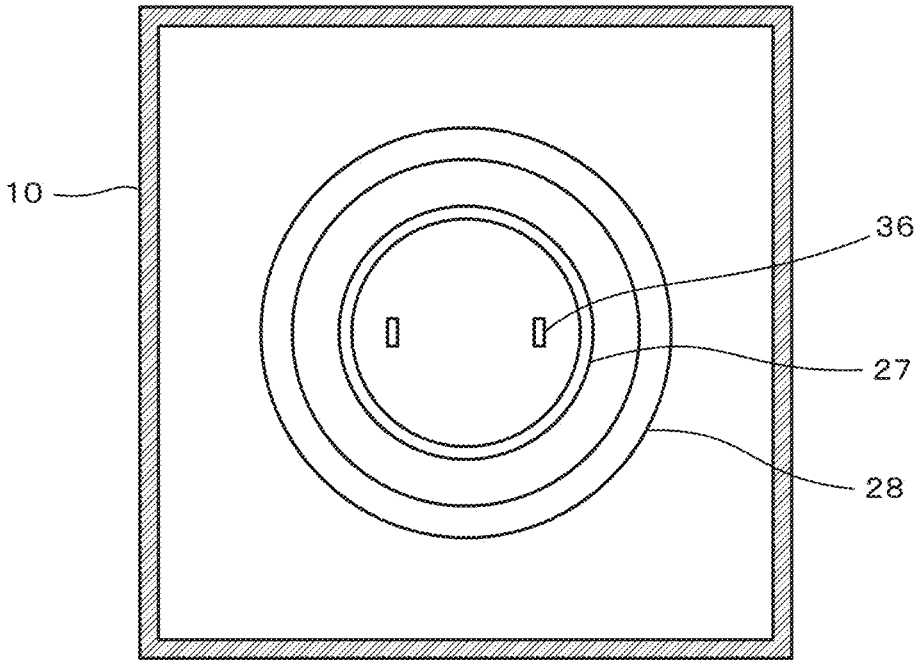
FIG. 3 is a cross-sectional view along line III-III in FIG. 1.

FIG. 1 is a front sectional view illustrating a plating apparatus 100 according to a first preferred embodiment of the present invention, FIG. 2 is a sectional view taken along line II-II of FIG. 1, and FIG. 3 is a sectional view taken along line III-III of FIG. 1.

As illustrated in FIGS. 1 to 3, the plating apparatus 100 includes a plating tank 10 which stores a plating solution 1, and a plating unit 20 which is disposed inside the plating tank 10 and performs an electrolytic plating on a plating object 2.

In order to perform an electrolytic plating on the plating object 2, the plating solution 1 is stored in the plating tank 10 to a level higher than an upper end of a cathode 26 to be described later.

The plating unit 20 includes at least a partition wall 22, an injector 24, a mixing portion 25, an anode 21, a cathode 26, a first shielding wall 27, and a second shielding wall 28.

The partition wall 22 allows the plating solution 1 to pass through but does not allow the plating object 2 to pass through, and defines inside thereof a plating object passage 23 through which the plating object 2 passes downward. In the present preferred embodiment, the partition wall 22 has a cylindrical or substantially cylindrical shape, for example, and is preferably made of, for example, mesh material. In the present preferred embodiment, an upper portion and a lower portion of the partition wall 22 are impermeable to liquid.

The plating object passage 23 is a region between the partition wall 22 and a cathode 26 which is disposed inside the partition wall 22 as to be described later.

The injector 24 includes a circulation line 32, a pump 33, and a filter 34.

The circulation line 32 is a flow path to circulate the plating solution 1 so as to inject the plating solution 1 in the plating tank 10 from an injection port 24*a* provided at the bottom of the plating tank 10.

The pump 33 is provided in the circulation line 32 and injects the plating solution 1 in the plating tank 10 through the circulation line 32 from the injection port 24*a*.

The filter 34 removes foreign substances contained in the plating solution 1 flowing through the circulation line 32.

The mixing portion 25 is provided above the injector 24 and below the plating object passage 23 and the cathode 26. The mixing portion 25 has a truncated cone shape which includes an upper surface greater than a lower surface in diameter. The diameter of the upper surface of the mixing portion 25 is equal to or larger than the inner diameter of the lower portion of the partition wall 22 which is impermeable to liquid. The diameter of the lower surface of the mixing portion 25 is the same or substantially the same as the diameter of the injection port 24*a* of the injector 24.

The upper surface of the mixing portion 25 is open, and is in communication with the plating object passage 23 and a hollow region 26*a* provided inside the cathode 26. The lower surface of the mixing portion 25 is also open, and is in communication with the injection port 24*a*. The truncated-cone-shaped space of the mixing portion 25 is defined by providing a through-hole corresponding to the truncated-cone shape of the mixing portion 25 in a member 25*a* having the same or substantially the same height as that of the mixing portion 25.

The mixing portion 25 is a region to mix a fluid that contains the plating solution 1 and the plating object 2 which is concentrated to a higher ratio due to precipitation while passing through the plating object passage 23 with the plating solution 1 injected from the injection port 24*a* upward. The fluid containing the plating object 2 at a higher ratio and the plating solution 1 injected upward from the injection port 24*a* are mixed by an injection force of the plating solution 1 injected from the injection port 24*a* while they are being guided into the hollow region 26*a*.

A voltage is applied to the anode 21 and the cathode 26 from a power supply 31. In the present preferred embodiment, the anode 21 is used as a positive electrode, and the cathode 26 is used as a negative electrode.

The cathode 26 is preferably, for example, a metal pipe, and is disposed inside the plating object passage 23. The cathode 26 is hollow inside, and the hollow portion defines the hollow region 26*a* through which the fluid mixture 3 of the plating solution 1 and the plating object 2 flows upward. The cathode 26 is suspended from above by a suspension member 36. The upper end of the cathode 26 is located higher than the upper end of the partition wall 22.

The anode 21 has a cylindrical or substantially cylindrical shape, for example, and is disposed outside the plating object passage 23. As illustrated in FIG. 2, the partition wall surrounds the cathode 26, and the anode 21 surrounds the partition wall 22. Further, as illustrated in FIG. 2, the cathode 26, the partition wall 22, and the anode 21 are concentrically arranged so that they share the same central axis.

In other words, the region between the inner peripheral surface of the partition wall 22 and the outer peripheral surface of the cathode 26 that are concentrically arranged defines the plating object passage 23. Thus, it is possible to make the current density uniform during plating, which makes it possible to form a uniform plating film. In addition, since the current density is uniform, as long as the current density is increased within a limit current density, there is no portion where the current density exceeds the limit current density, so that the current density may be set higher to improve productivity.

In order to make the current density in the plating object passage 23 uniform, a mask may be provided between the partition wall 22 and the anode 21 so as to surround a lower portion of the plating object passage 23.

In the present preferred embodiment, the upper end of the anode 21 is located lower than the liquid level of the plating solution 1. A first insulator 35 is provided above the anode 21 so as to cover the anode 21 when viewed from the above. In the present preferred embodiment, the first insulator 35 is in contact with the upper end of the anode 21. By providing the first insulator 35, it is possible to reduce the current flowing from above the anode 21 to the cathode 26.

The first insulator 35 may not be provided. However, as described later, by providing the first insulator 35 above the anode 21, it is possible to further reduce the current flowing from the anode 21 to the cathode 26 via the plating solution 1 flowing out of the upper end of the second shielding wall 28, which makes it possible to effectively prevent the bipolar phenomenon from occurring.

The first shielding wall 27 is disposed above the cathode and outside the cathode 26 when viewed in the extending direction of the plating object passage 23 to guide the fluid mixture 3 to pass through the hollow region 26*a* downward. The first shielding wall 27 does not allow both the plating solution 1 and the plating object 2 to pass through.

As illustrated in FIG. 3, the second shielding wall 28 is disposed outside the first shielding wall 27. The second shielding wall 28 does not allow both the plating solution 1 and the plating object 2 to pass through. Further, the second shielding wall 28 is joined to a guide 30 to be described later such that no gap is present between the second shielding wall 28 and the guide 30.

The upper end of the second shielding wall 28 is located higher than the liquid level of the plating solution 1. In the present preferred embodiment, the "liquid level of the plating solution 1" refers to the liquid level of the plating solution 1 outside the second shielding wall 28.

The lower end of the first shielding wall 27 is located lower than the upper end of the second shielding wall 28.

The plating unit 20 of the present preferred embodiment further includes a fluid guide 29 which guides the fluid mixture 3 that has passed upward through the hollow region 26*a* of the cathode 26 to the outside when colliding with the same. The fluid guide 29 is disposed above the cathode 26.

The fluid guide 29 may not be provided. However, according to the plating apparatus 100 of the present preferred embodiment, by providing the fluid guide 29, it is possible to smoothly guide the fluid mixture 3 that has passed through the hollow region 26*a* of the cathode 26 upward to the outside. As a result, it is possible to reduce or prevent bubbles from being formed in the plating solution 1 and reduce or prevent the plating solution from being oxidized especially when an Sn plating solution is used. Therefore, it is possible to increase the life time of the plating bath.

Thus, according to the plating apparatus 100 of the present preferred embodiment, by disposing the fluid guide 29 above the cathode 26, it is possible to smoothly guide the fluid mixture 3 that has passed through the hollow region 26*a* of the cathode 26 upward to the outside.

The plating unit 20 of the present preferred embodiment further includes a guide 30 having a truncated cone shape whose upper surface is larger than its lower surface. The upper surface and the lower surface of the guide 30 are defined by openings, and the side surface does not allow both the plating solution 1 and the plating object 2 to pass through. The diameter of the lower opening of the guide 30 is equal to or smaller than the inner diameter of the upper portion of the partition wall 22 which is impermeable to liquid.

Figure 4:
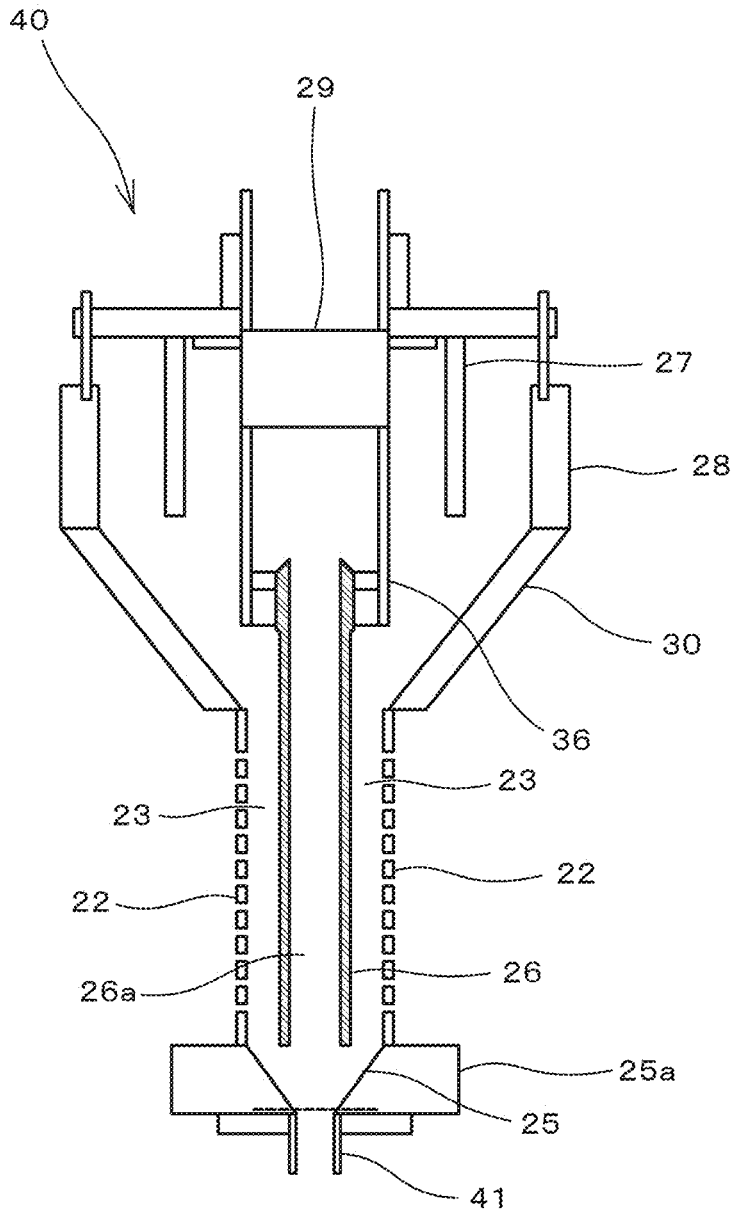
FIG. 4 is a view illustrating a detachable section including a partition wall, a mixing portion, a cathode, a first shielding wall, a second shielding wall and a guide.

As illustrated in FIG. 4, the partition wall 22, the mixing portion 25, the cathode 26, the first shielding wall 27, the second shielding wall 28, the fluid guide 29, and the guide 30 may be integrally detached from the plating apparatus 100. Hereinafter, the partition wall 22, the mixing portion 25, the cathode 26, the first shielding wall 27, the second shielding wall 28, the fluid guide 29, and the guide 30 which may be integrally detached are also referred to as a detachable section 40.

Figure 5:
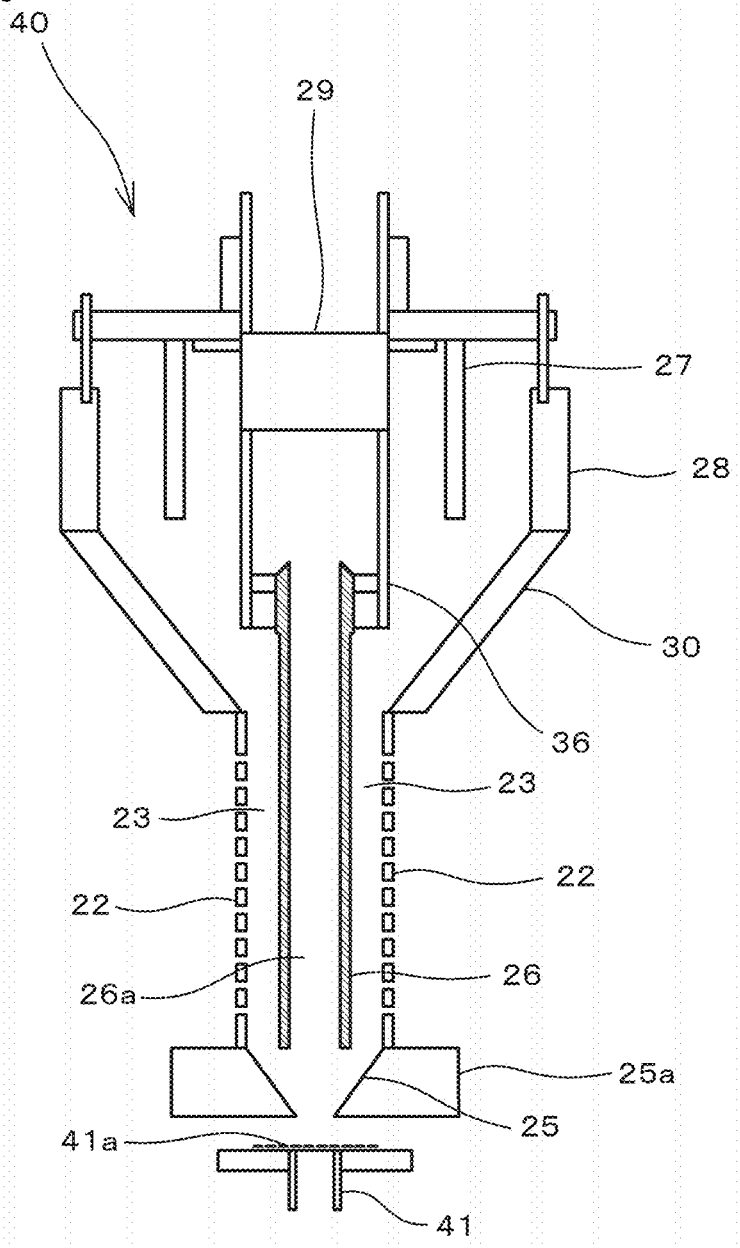
FIG. 5 is a view illustrating the detachable section from which a front end thereof is removed.

As illustrated in FIG. 5, a front end 41 provided at the lower portion of the detachable section 40, in other words, at the lower portion of the mixing portion 25 may be detached therefrom. The front end 41 includes a diaphragm 41*a* which allows the plating solution 1 to pass through but does not allow the plating object 2 to pass through. The diaphragm 41*a* prevents the plating object 2 from falling into the injection port 24*a* while the plating object 2 is being plated.

Next, a non-limiting example of a method for plating the plating object 2 using the plating apparatus 100 configured as described above will be described.

The plating method of the present invention includes (a) guiding the fluid mixture 3 of the plating solution 1 and the plating object 2 into the plating object passage 23 that is at least partially surrounded by the partition wall 22 which allows the plating solution 1 to pass through but does not allow the plating object 2 to pass through, (b) performing an electrolytic plating on the plating object 2 by applying a voltage between the anode 21 which is disposed outside the plating object passage 23 and the cathode 26 which is disposed inside the plating object passage 23 while the plating object 2 is being guided to pass through the plating object passage 23 downward, (c) injecting the plating solution 1 from a position below the cathode 26 upward so as to mix the injected plating solution 1 and the plating object 2 that has passed through the plating object passage 23 and force the fluid mixture 3 of the plating solution 1 and the plating object 2 to pass through the hollow region 26*a* provided inside the cathode 26 upward, (d) guiding the fluid mixture 3 that has passed through the hollow region 26*a* downward along the first shielding wall 27 which is disposed above the cathode 26 and outside the cathode 26 when viewed in the extending direction of the plating object passage 23, and (e) guiding at least a portion of the plating solution 1 in the fluid mixture 3 that has been guided downward along the first shielding wall 27 upward along the second shielding wall 28 which is disposed outside the first shielding wall 27 to flow out of the upper end of the second shielding wall 28.

In other words, the plating object 2 is plated by repeating the steps (a) to (e) in order.

The step (a) is a step of guiding the fluid mixture 3 of the plating solution 1 and the plating object 2 in the guide 30 into the plating object passage 23. At least a portion of the plating solution 1 of the fluid mixture 3 of the plating solution and the plating object 2 that has passed through the hollow region 26*a* of the cathode 26 upward flows to flow out of the upper end of the shielding wall 28 in the step (e). The plating object 2 contained in the fluid mixture 3 precipitates due to its own weight, and is guided into the plating object passage 23 along the guide 30 at the same time.

In the step (b), the plating object 2 guided into the plating object passage 23 in the step (a) passes through the plating object passage 23 downward. While the plating object 2 is being guided to pass through the plating object passage 23, a voltage is applied between the anode 21 and the cathode 26 to perform an electrolytic plating on the plating object 2.

More specifically, in the step (b), the plating object 2 guided into the plating object passage 23 accumulates in the plating object passage 23, and gradually precipitates in the accumulated state. As described above, since the cathode 26, the partition wall 22, and the anode 21 are arranged concentrically so that they share the same central axis, the plating may be performed stably and consistently on the plating object 2 passing through the plating object passage 23 with a uniformly distributed current density, which makes it possible to reduce or prevent the plating film from varying in thickness so as to provide a plating film with a uniform thickness.

Further, as described above, the upper portion and the lower portion of the partition wall 22 are impermeable to liquid. By making the upper portion of the partition wall 22 impermeable to liquid, it is possible to reduce the influence from the liquid flow in the guide 30 above the plating object passage 23. In addition, by making the lower portion of the partition wall 22 impermeable to liquid, it is possible to reduce or prevent the influence from the liquid flow of the plating solution 1 injected below the plating object passage 23. Thus, the plating object 2 is enabled to pass through the plating object passage 23 stably.

In the step (c), the plating solution 1 in the plating tank 10 is injected by the injector 24 from the injection port 24*a* through the circulation line 32. Due to a suction force of the injection flow from the injection port 24*a*, the plating object 2 that has passed through the plating object passage 23 is mixed with the plating solution 1 injected from the injection port 24*a* in the mixing portion 25. At this time, the plating object 2 precipitated while accumulating in the plating object passage 23 is loosened by the shearing force of the injection flow from the injection port 24*a* in the mixing portion 25, and dispersed in the plating solution 1 to become the fluid mixture 3. The fluid mixture 3 of the plating solution 1 and the plating object 2 is forced by the injection flow from the injection port 24*a* to pass through the hollow region 26*a* of the cathode 26 upward and injected out from the upper end of the hollow region 26*a* upward.

Thus, the injector 24 actuates the pump 33 to inject the plating solution 1 from the injection port 24*a* so that the fluid mixture 3 of the plating solution 1 and the plating object 2 is forced to pass through the hollow region 26*a* of the cathode 26 and injected upward out of the upper end of the hollow region 26*a*.

In the step (d), the fluid mixture 3 which has passed through the hollow region 26*a* upward and been injected out of the upper end of the hollow region 26*a* is guided downward along the first shielding wall 27. In other words, the fluid mixture 3 injected out of the upper end of the hollow region 26*a* collides with the fluid guide 29 disposed above the cathode 26 and is thus guided to the outside, and thereafter it collides with the first shielding wall 27, and is thus guided downward along the first shielding wall 27.

In the step (e), in the fluid mixture 3 guided downward along the first shielding wall 27, the plating object 2 having a higher specific gravity precipitates and accumulates. On the other hand, at least a portion of the plating solution 1 in the fluid mixture 3 is blocked from flowing downward by the accumulated plating object 2, and thus, it flows upward along the second shielding wall 28 disposed outside the first shielding wall 27, and flows out of the upper end of the second shielding wall 28.

In other words, in the fluid mixture 3, the plating object 2 precipitates, and the plating solution 1 flows upward along the second shielding wall 28, which makes it possible to effectively separate the plating object 2 and the plating solution 1. Since the plating object 2 and the plating solution 1 are separated without applying an external force, it is possible to reduce or prevent the surface of the plating object 2 after plating from being damaged. Further, the plating solution 1 rapidly changes its direction at the lower end of the first shielding wall 27 to flow upward, which makes it possible to quickly separate the plating object 2 and the plating solution 1.

In the present preferred embodiment, the plating object 2 is prevented from flowing out of the second shielding wall 28 by setting the average flow speed of the plating solution 1 flowing upward in the region between the first shielding wall 27 and the second shielding wall 28 equal to or smaller than the average precipitating speed of the plating object 2. The average flow speed of the plating solution 1 flowing upward in the region between the first shielding wall 27 and the second shielding wall 28 may be controlled by adjusting a gap between the first shielding wall 27 and the second shielding wall 28.

Thereafter, the steps (a) to (e) are repeated in this order so as to perform the electrolytic plating on the plating object 2. Since the plating object 2 passes through the plating object passage 23 several times, it is possible to reduce or prevent the variation in the plating film thickness of each plating object 2, which makes it possible to obtain a plating film having a desired thickness.

As described above, the plating apparatus 100 of the present preferred embodiment includes a first shielding wall 27 which is disposed above the cathode 26 and outside the cathode 26 when viewed in the extending direction of the plating object passage 23, and a second shielding wall 28 which is disposed outside the first shielding wall 27, and the lower end of the first shielding wall 27 is located lower than the upper end of the second shielding wall 28. With such a configuration, at least a portion of the plating solution 1 of the fluid mixture 3 that has passed through the hollow region 26*a* of the cathode 26 upward flows out of the upper end of the second shielding wall 28. In other words, in the fluid mixture 3, the plating object 2 having a higher specific gravity precipitates and accumulates, but at least a portion of the plating solution 1 is blocked from flowing downward by the accumulated plating object 2, and thus it flows upward along the second shielding wall 28 and flows out of the upper end of the second shielding wall 28.

Therefore, in comparison with the plating apparatus described in WO 2017/217216 in which the plating solution 1 flows out by passing through the plating solution passage, the plating apparatus 100 of the present preferred embodiment is provided with the first shielding wall 27 and the second shielding wall 28, and thus, the flow path of the plating solution 1 becomes complicated, and the plating solution 1 has to flows out by exceeding the upper end of the second shielding wall 28, which makes it possible to reduce the amount of the plating solution 1 flowing out of the second shielding wall 28. As a result, it is possible to reduce the current flowing from the anode 21 to the cathode 26 over the upper end of the second shielding wall 28, which makes it possible to effectively reduce or prevent the bipolar phenomenon from occurring, and thus, prevent the reliability of the plated object 2 from being reduced.

In addition, in the plating apparatus described in International Publication No. WO 2017/217216, a portion of the plating objects flowing through the plating solution passage may stick to the plating solution passage and may be immobilized by the same. Such problem is likely to occur when the plating object has a small size such as a length of about 1.0 mm, a width of about 0.5 mm and a thickness of about 0.5 mm, or even smaller. In this case, the plating object may not be plated properly.

However, in the plating apparatus 100 of the present preferred embodiment, since the second shielding wall 28 is impermeable to liquid, the problem mentioned above will not occur. Therefore, even though the plating object 2 has a small size such as a length of about 1.0 mm, a width of about 0.5 mm and a thickness of about 0.5 mm, or even smaller, the plating object may be plated properly.

Further, since the upper end of the second shielding wall 28 is located higher than the liquid level of the plating solution 1, it is possible to further reduce the amount of the plating solution 1 flowing out of the upper end of the second shielding wall 28 during the plating, which makes it possible to reduce or prevent the bipolar phenomenon from occurring.

Furthermore, in the plating apparatus 100 of the present preferred embodiment, the upper end of the anode 21 is located lower than the liquid level of the plating solution 1 and the first insulator 35 is provided above the anode 21 so as to cover the anode 21 when viewed from the above. Thus, it is possible to further reduce the current flowing from the anode 21 to the cathode 26 via the plating solution 1 flowing out of the upper end of the second shielding wall 28, which makes it possible to effectively reduce or prevent the bipolar phenomenon from occurring, and thus prevent the reliability of the plated object 2 from being reduced.

In addition, similar to the plating apparatus described in WO 2017/217216, the plating apparatus 100 of the present preferred embodiment is long in the vertical direction, compared with the plating apparatus provided with a rotating barrel which includes a rotating shaft in the horizontal direction. Thus, it is possible to reduce the floor area required to install the plating apparatus so as to improve the area productivity. Further, since the pump 33 for pumping the plating solution 1 may be used as the driving source for flowing the plating object 2, it is possible to simplify the structure of the plating unit 20 so as to reduce the maintenance cost.

After the electrolytic plating is completed, the plated object 2 is washed. In order to wash the plating object 2, the detachable section 40, in other words, the partition wall 22, the mixing portion 25, the cathode 26, the first shielding wall 27, the second shielding wall 28, the fluid guide 29, and the guide 30 which may be integrally detached is raised from the plating tank 10. After the detachable section 40 is raised, the plating solution 1 flows out by passing through the partition wall 22. On the other hand, the plated object 2 is not allowed to flow out, and thus remains accumulated in the plating object passage 23 and the mixing portion 25.

Figure 6:
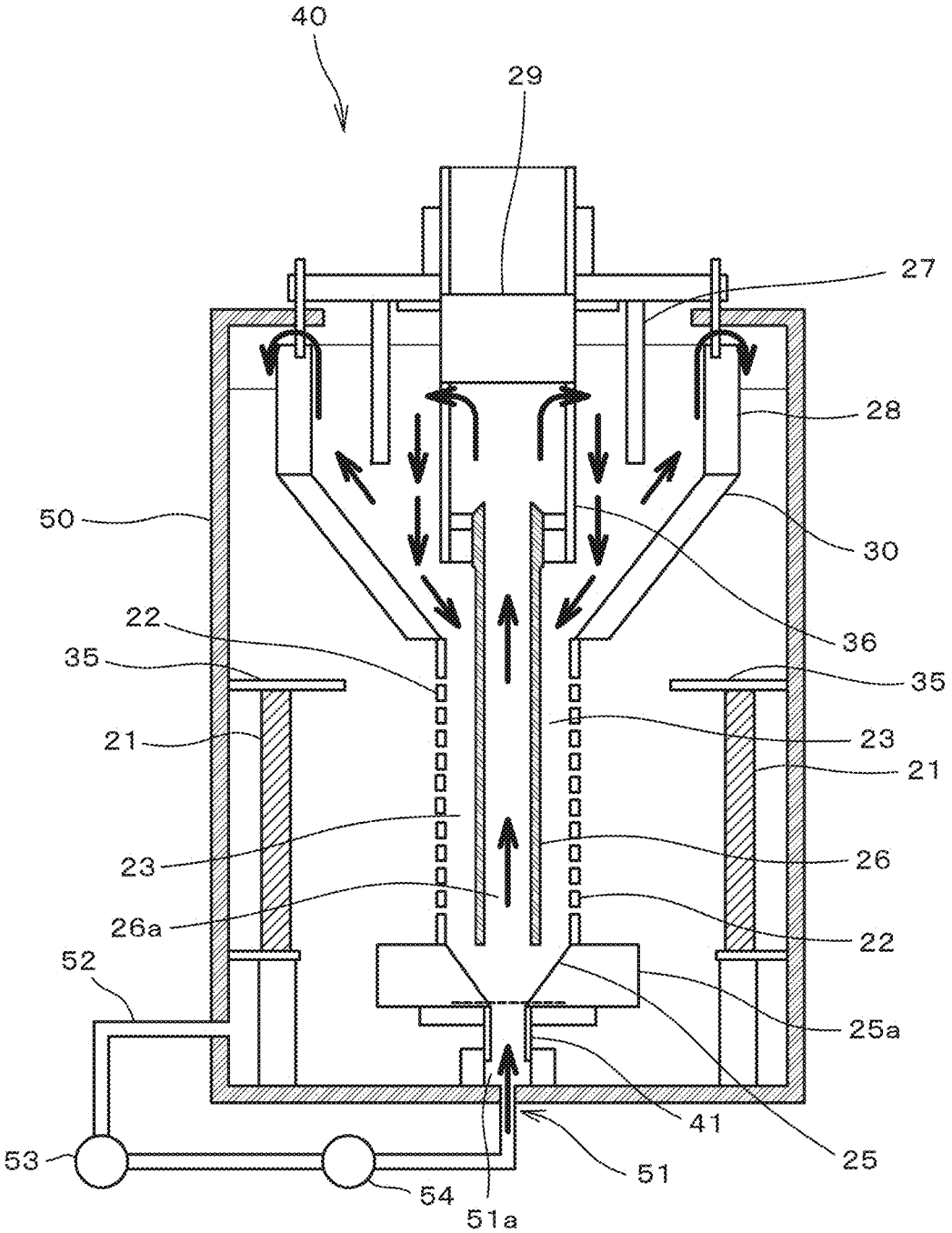
FIG. 6 is a view illustrating a state in which the detachable section is immersed in a washing tank so as to wash a plated object.

As illustrated in FIG. 6, after the plating solution 1 flows out by passing through the partition wall 22, the detachable section 40 is disposed in a washing tank 50 prepared in advance. Specifically, the front end 41 of the detachable section 40 is connected to an injection port 51*a* provided at the bottom of the washing tank 50. The washing tank 50 is stored with the washing liquid to a liquid level higher than the upper end of the cathode 26.

An injector 51 having the same or similar configuration as the injector 24 provided in the plating unit 100 illustrated in FIG. 1 is provided for the washing tank 50. The injector 51 includes a circulation line 52, a pump 53, and a filter 54 to remove foreign substances.

At the time of washing the plated object 2, the pump 53 is actuated so as to inject the washing liquid stored in the washing tank 50 from the injection port 51*a* through the circulation line 52. As a result, the washing liquid injected from the injection port 51*a* is mixed with the plated object 2 in the mixing portion 25, and flows through the hollow region 26*a* of the cathode 26 upward. Then, a portion of the washing liquid in the fluid mixture 3 of the plated object 2 and the washing liquid injected out of the upper end of the hollow region 26*a* flows out of the upper end of the second shielding wall 28. The plated object 2 in the fluid mixture 3 precipitates due to its own weight, and is guided into the plating object passage 23 along the guide 30 at the meantime.

The plated object 2 that has passed downward through the plating object passage 23 is mixed with the washing liquid in the mixing portion 25, and then is circulated upward in the hollow region 26*a* of the cathode 26. In this way, by washing the plated object 2 while circulating the same, it is possible to wash the plated object 2 in a short time.

Also, since the washing may be conducted by circulating the washing liquid, only a small amount of the washing liquid is required, which makes it possible to reduce the amount of the washing liquid to be used.

After the plated object 2 is washed, the detachable section 40 is raised so as to remove the front end 41, the plated object 2 may be taken out from the lower opening of the mixing portion 25. Thus, the plated object 2 may be taken out easily. Further, since whether or not the plated object 2 remains on the partition wall 22 may be checked visually, it is possible to prevent a subsequent plating process from being conducted while the previously plated object 2 remains inside the detachable section 40.

EXAMPLE 1

A multilayer ceramic capacitor having a length of about 1.0 mm, a width of about 0.5 mm and a thickness of about 0.5 mm, for example, was prepared as the plating object 2, and the external electrodes of the multilayer ceramic capacitor were subjected to Ni plating and Sn plating by a method to be described later. The plating object 2 was first subjected to the Ni plating, and then to the Sn plating.

In the plating apparatus 100 having the configuration illustrated in FIGS. 1 to 3, the liquid-permeable portion of the cylindrical partition wall 22 is preferably made of, for example, mesh material of 80 mesh, and has a diameter of about 70 mm and a length of about 100 mm, for example. The liquid-impermeable upper portion and the liquid-impermeable lower portion relative to the liquid-permeable portion were preferably defined by a pipe which is made of, for example, plastic such as acrylic, polypropylene, vinyl chloride, and polycarbonate and has a diameter of about 70 mm.

On the top of the partition wall 22, a truncated cone-shaped guide 30 having a vertical angle of about 90° was provided. The diameter of the lower opening of the guide 30 is the same or substantially the same as the diameter of the partition wall 22.

On the top of the guide 30, a cylinder having a diameter of about 200 mm and a length of about 100 mm, for example, was provided as the second shielding wall 28. The guide 30 and the second shielding wall 28 were arranged such that no gap is present therebetween.

A pipe having a diameter of about 140 mm and a length of about 100 mm, for example was suspended from the above inside the second shielding wall 28 as the first shielding wall 27. The lower end of the first shielding wall 27 was located lower than the upper end of the second shielding wall 28.

A stainless steel pipe having an outer diameter of about 35 mm and an inner diameter of about 25 mm, for example, was disposed inside the partition wall 22 as the cathode 26. In the outer surface of the pipe, a portion corresponding to the plating area where the plating object 2 is plated was electrically conductive, but the portion higher than the plating area and the inner surface of the pipe were coated with an insulating material. The gap between the lower end of the pipe and the lower end of the mixing portion 25 having a truncated cone shape was about 15 mm, for example, and the upper end of the pipe was located near the central point of the height of the guide 30. The pipe was suspended from the above by the suspension member 36, and was connected to the negative electrode of the power supply 31.

A deflector defining and functioning as the fluid guide 29 was disposed above the cathode 26. The lower surface of the deflector, in other words, the surface impacted by the fluid mixture 3 that has passed through the hollow region 26*a* of the cathode 26 upward was arranged lower than the liquid level of the plating solution 1 when the plating tank 10 is stored with the plating solution 1.

An anode case which is preferably made of titanium and has an annular shape was arranged outside the partition wall 22 at an interval of about 100 mm, for example. The anode case was provided with a space that may be filled with Ni chips from the above, and the space was filled with Ni chips. The anode case filled with Ni chips was connected to the positive electrode of the power supply 31 as the anode 21.

A mixing portion 25 having a vertical angle of about 90°, for example, was provided below the partition wall 22.

A Watts bath was used as the plating solution 1 stored in the plating tank 10. As described above, an injection port 24*a* was provided at the bottom of the plating tank 10.

In the present example, it was discovered that if the diameter of the injection port 24*a* was set to about 30 mm which is larger than the inner diameter (about 25 mm) of the cathode 26, the circulation of the plating object 2 was not stable. On the contrary, if the diameter of the injection port 24*a* was set to about 12 mm which is smaller than the inner diameter of the cathode 26, the plating object 2 may be circulated, but the plating object 2 is blown up vigorously, which may exert a strong impact to the plating object 2. However, if the diameter of the injection port 24*a* was set to about 16 mm which is about 60% or more of the inner diameter of the cathode 26, the plating object 2 was circulated stably and the plating object 2 was not blown up vigorously.

Thus, the diameter of the injection port 24*a* is preferably smaller than the inner diameter of the cathode 26, and more preferably, for example, about 60% or more of the inner diameter of the cathode 26. In the present example, the diameter of the injection port 24*a* was set to about 20 mm, for example.

The front end 41 provided at the lower portion of the mixing portion 25 was fitted into the injection port 24*a*. Further, the plating solution 1 was filled into the plating tank 10 to a level higher than the upper end of the cathode 26.

After the pump 33 of the injector 24 was actuated, the plating solution 1 in the plating tank 10 was injected upward from the injection port 24*a* via the circulation line 32. The plating solution 1 injected from the injection port 24*a* flowed through the hollow region 26*a* of the cathode 26 and was injected upward from the upper end of the cathode 26.

As the plating object 2, 1200000 multilayer ceramic capacitors and about 120 cc of a conductive medium having a diameter of about 0.7 mm, for example, were added into the plating tank 10, more specifically, inside the second shielding wall 28 having a cylindrical shape. The added plating object 2 gradually precipitated while accumulating in the plating object passage 23. Then, the plating object 2 was sucked by the plating solution 1 injected from the injection port 24*a* into the mixing portion 25, mixed with the plating solution 1 in the mixing portion 25, and injected upward after passing through the hollow region 26*a* of the cathode 26. A portion of the plating solution 1 in the fluid mixture 3 of the injected plating solution 1 and the plating object 2 flowed out of the upper end of the second shielding wall 28 and returned back into the injector through the circulation line 32 to be injected again from the injection port 24*a*. Meanwhile, the plating object 2, together with the remaining portion of the plating solution 1, in other words, the plating solution 1 that has not flowed out of the upper end of the second shielding wall 28, was guided into the plating object passage 23 along the guide 30, and gradually precipitated in the plating object passage 23 while accumulating.

As described above, while the plating object 2 was circulated repeatedly, the power supply 31 was turned on to energize the anode 21 and the cathode 26 with a current of 20 A so as to apply a voltage therebetween. After the energization was conducted for about 180 minutes to a predetermined amount of current, the power supply 31 was turned off. Then, the detachable section 40 was raised from the plating tank 10, and the plating solution 1 in the plating tank 1 was removed. Thereafter, the detachable section 40 was immersed in the washing tank 50 filled with pure water as the washing liquid.

As described above, the injection port 51*a* is provided at the bottom of the washing tank 50, the front end 41 of the detachable section 40 is connected to the injection port 51*a*, and the pump 53 is actuated so as to circulate the plating object 2 through the path of the plating object passage 23, the mixing portion 25, the hollow region 26*a* of the cathode 26, and the guide 30 for washing. Thereafter, the detachable section 40 was raised and moved to another washing tank, and the washing process was repeated in the same manner for 3 times, for example.

After the plating object 2 was washed, the detachable section 40 was immersed in the plating tank 10 filled with the Sn plating solution, and the plating object 2 was subjected to the Sn plating by the same or similar procedure as the Ni plating described above. The condition for energizing the anode 21 and the cathode 26 was about 15 A for about 120 minutes, for example.

After the plating object 2 was subjected to the Sn plating, the plated object 2 was washed in the same or similar manner as that after the Ni plating.

Figure 7:
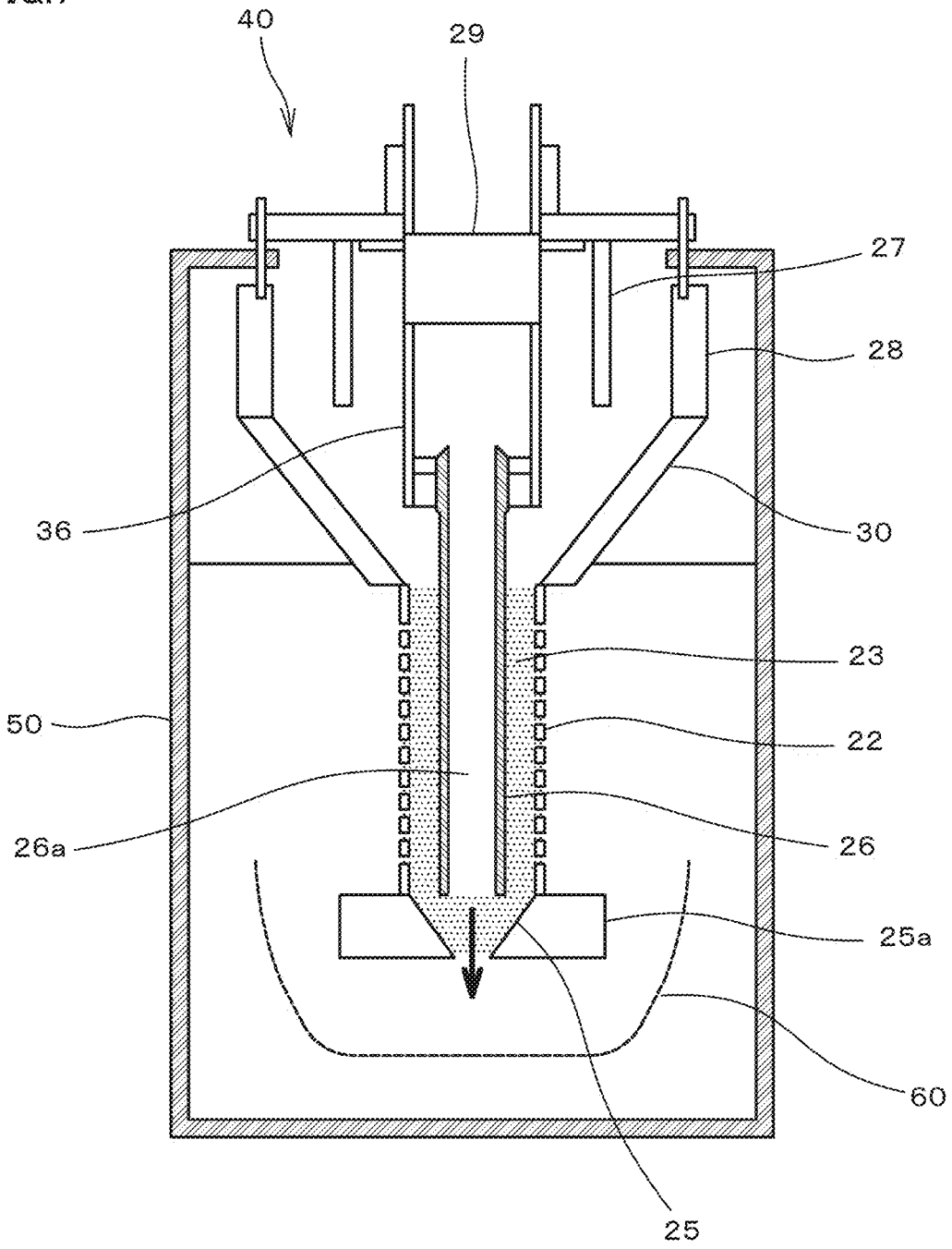
FIG. 7 is a view explaining how to take out a plated object.

As illustrated in FIG. 7, after the washing of the plating object 2 was completed, while at least the upper end of the partition wall 22 was immersed in the washing water, the detachable section 40 was detached from the injection port 51*a* of the washing tank 50, and a collection container 60 was disposed under the detachable section 40. The collection container 60 includes a main portion made of mesh material having a mesh size that allows the plating solution 1 to pass through but does not allow the plating object 2 to pass through. Then, the front end 41 provided at the lower portion of the detachable section 40 was removed (see FIGS. 4 and 5). Thus, the plating object 2 accumulated in the plating object passage 23 and the mixing portion 25 is settled and collected in the collection container 60. At this time, the washing water was made to flow through the detachable section 40 downward so that all of the plated objects 2 were collected in the collection container 60.

As described above, since the collection container 60 includes a liquid permeable portion made of mesh material having a mesh size that allows the plating solution 1 to pass through but does not allow the plating object 2 to pass through, after the collection container 60 was raised, the water flows out of the collection container 60, and only the plated object 2 may be collected.

The thickness of the Ni film and the thickness of the Sn film on the plated object 2 collected in the collection container were measured at 30 places using a fluorescent x-ray film thickness meter. The average thickness of the Ni film was about 3.35 μm, the CV (standard deviation/average value) indicating the thickness variation was about 6.9%, the average thickness of the Sn film was about 3.1 μm, and the CV indicating the thickness variation was about 5.4%, which were good results. In other words, according to the plating apparatus 100 of the present preferred embodiment, the thickness variation of the plated film is reduced.

The recovery rate of the chips was confirmed. It was confirmed that the number of chips that could not be recovered was zero. A mounting test was conducted on 20000 chips by using a mounting machine, and no soldering failure was found.

On the other hand, when the plating object was subjected to Ni plating and Sn plating in the same or similar manner by using the plating apparatus described in WO 2017/217216, it was confirmed that some of the plating objects adhered to the plating solution passage. Further, when the film thickness of the Ni film and the film thickness of the Sn film were measured on 30 of the plated objects by using a fluorescent x-ray film thickness meter, the CV of the Ni film was about 8.9%, and the CV of the Sn film was about 6.2%. In other words, compared with the plating apparatus 100 according to the present preferred embodiment, the variation in the thickness of a film plated by the plating apparatus described in WO 2017/217216 is greater.

A mounting test was conducted by using a mounting machine on 20000 chips plated using the plating apparatus described in WO 2017/217216, and it was confirmed that 3 chips were poorly soldered.

In other words, according to the plating apparatus 100 of the present preferred embodiment, the plating may be stably conducted even on a plating object 2 having a small size such as, for example, a length of about 1.0 mm, a width of about 0.5 mm and a thickness of about 0.5 mm.

EXAMPLE 2

When the plating was conducted on the plating object 2 according to the method described in Example 1, the surface current density of the plated object 2 accumulated in the plating object passage 23 and the mixing portion 25 was measured. The energized current was about 30 A, and the surface current density was measured using a current density meter CD-200 manufactured by Fuji Kasei Corporation. The surface current density of the plated object obtained by using the plating apparatus described in WO 2017/217216 was also measured in the same or similar manner.

The surface current density of the plated object obtained by using the plating apparatus 100 of the present preferred embodiment was about 0.6 A/dm$^2$. On the contrary, the surface current density of the plated object obtained by using the plating apparatus described in WO 2017/217216 was about 2.3 A/dm$^2$.

As described above, in the plating apparatus 100 of the present preferred embodiment, the second shielding wall 28 is impermeable to liquid, and at least a portion of the plating solution 1 of the fluid mixture 3 that has passed through the hollow region 26*a* of the cathode 26 upward flows out of the upper end of the second shielding wall 28. Therefore, compared with the plating apparatus described in WO 2017/217216 in which the plating solution 1 passes through the plating solution passage and flows out, the amount of the plating solution 1 that flows out is reduced. Further, since the first insulator 35 is provided above the anode 21 so as to cover the anode 21 when viewed from the above, it is difficult for the current to flow from the anode 21 over the upper end of the second shielding wall 28 to the surface of the plated object 2. Due to these factors, compared with the plating apparatus described in WO 2017/217216, the surface current density of the plated object 2 obtained by using the plating apparatus 100 of the present preferred embodiment is reduced to about ¼.

A humidity and load test was conducted on chips plated using the plating apparatus 100 of the present preferred embodiment and on chips plated using the plating apparatus described in WO 2017/217216. The humidity and load test were conducted at a temperature of about 125° C. and a humidity of about 95% RH by applying a rated voltage of about 3.2 V to each chip for about 72 hours so as to measure the insulation resistance IR during that time. In the present example, a number of 18 chips were tested, and the logarithmic value log IR of the insulation resistance was calculated for each chip.

Figure 8A:
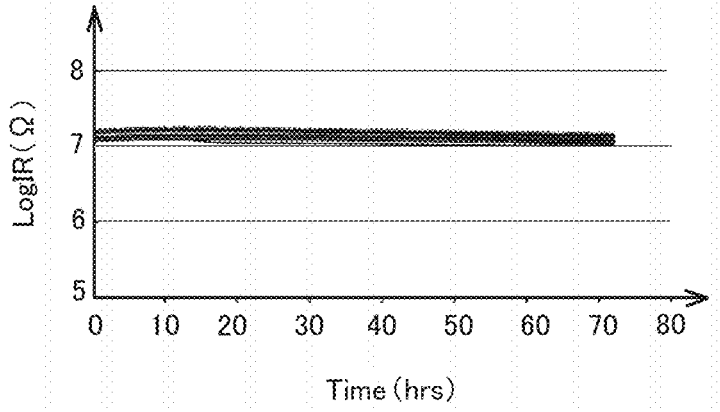
FIG. 8A is a view illustrating variations in insulation resistance of a chip which is plated using a plating apparatus according to a preferred embodiment of the present invention.
Figure 8B:
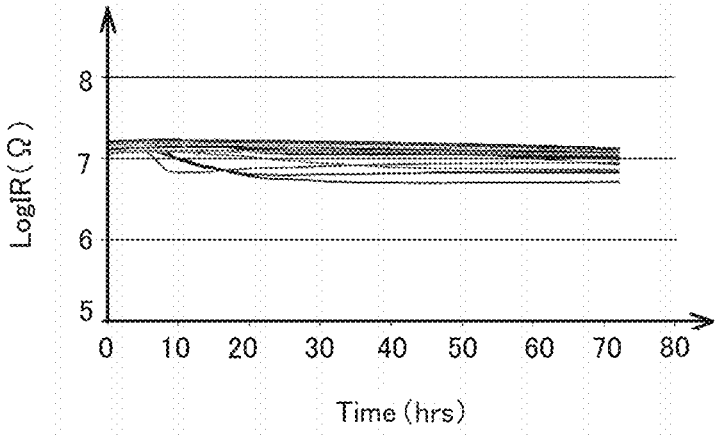
FIG. 8B is a view illustrating variations in insulation resistance of a chip which is plated using the plating apparatus described in WO 2017/217216.

As illustrated in FIG. 8B, in the chips plated using the plating apparatus described in WO 2017/217216, the insulation resistance of some chips decreased during the period in which the voltage is applied. This is probably because the external electrode was dissolved due to the occurrence of the bipolar phenomenon.

On the contrary, as illustrated in FIG. 8A, in the chips plated by using the plating apparatus 100 of the present preferred embodiment, the insulation resistance did not decrease significantly. In other words, when the plating apparatus 100 of the present preferred embodiment is used, the bipolar phenomenon is reduced or prevented from occurring, and thus the reliability of the chips is improved.

Second Preferred Embodiment

In the plating apparatus 100 according to the first preferred embodiment, the upper end of the anode 21 is located lower than the liquid level of the plating solution 1, and the first insulator 35 is provided above the anode 21 so as to cover the anode 21 when viewed from the above.

However, in a plating apparatus according to a second preferred embodiment of the present invention, the upper end of the anode 21 is located higher than the liquid level of the plating solution 1, and a portion of the anode 21 located higher than a region where the plating object is plated is covered with a second insulator.

Figure 9:
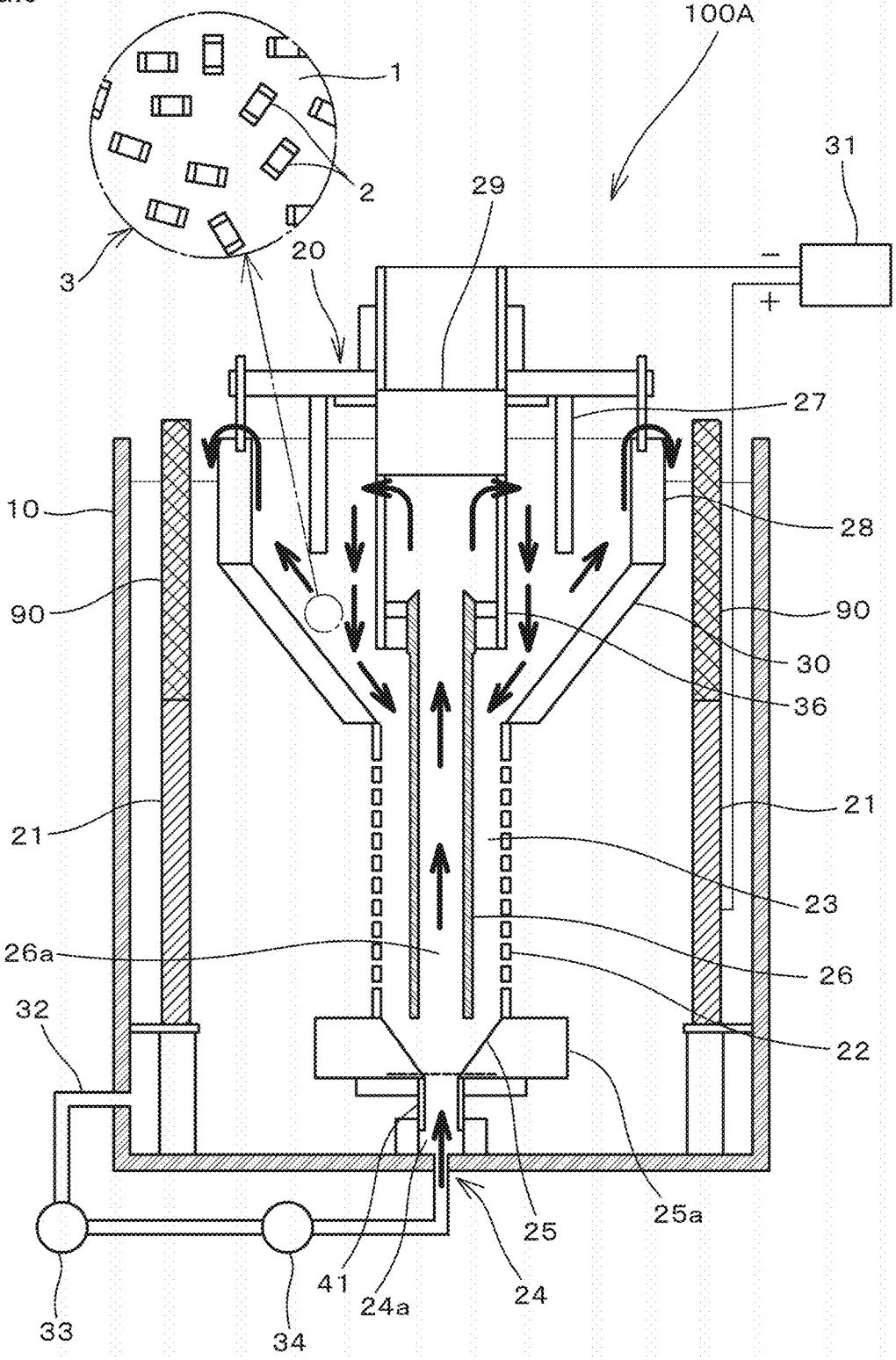
FIG. 9 is a front sectional view illustrating a plating apparatus according to a second preferred embodiment of the present invention.
Figure 10:
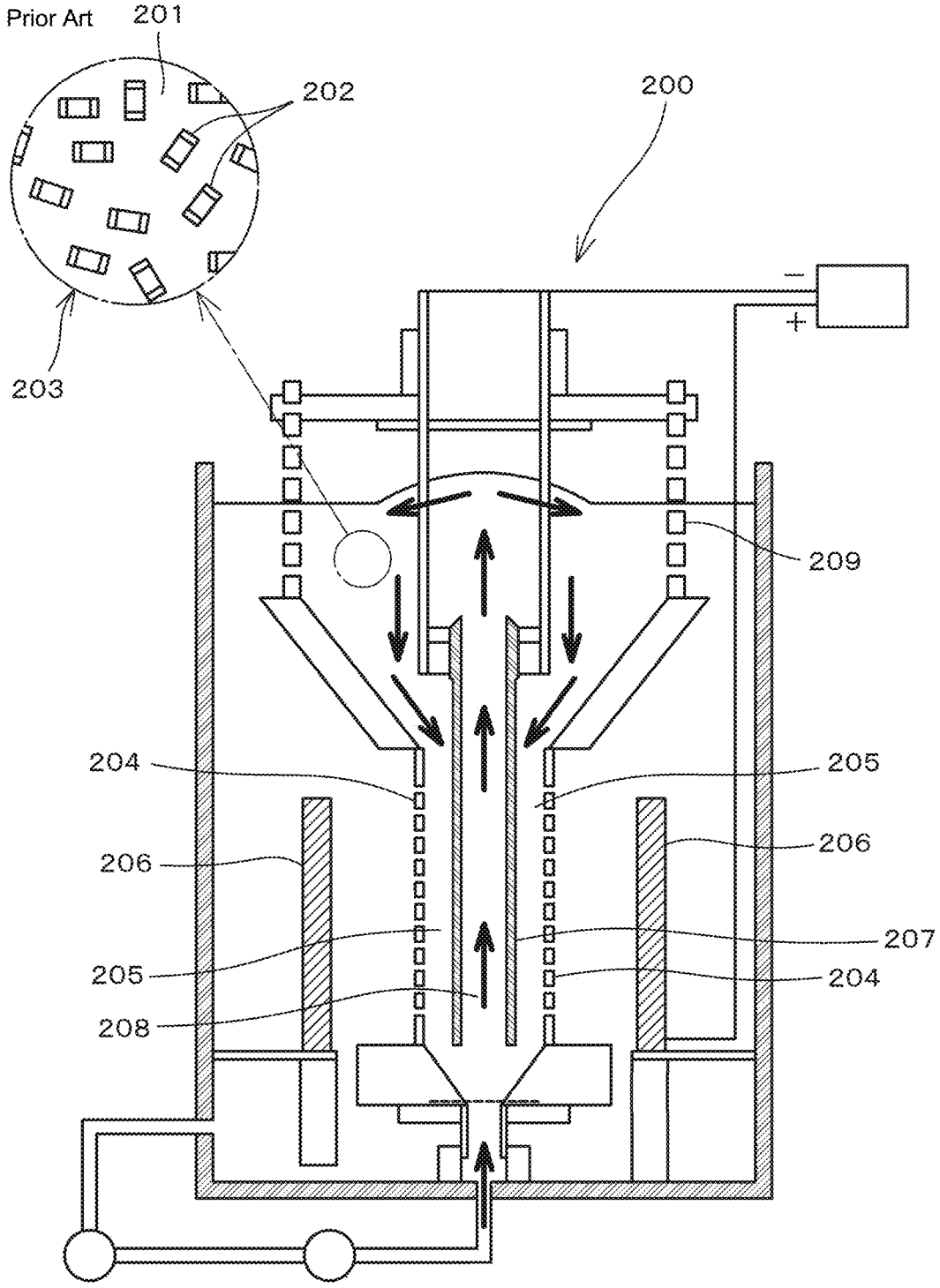
FIG.10 Prior Art
FIG. 10 is a front sectional view illustrating the plating apparatus described in WO 2017/217216.

FIG. 9 is a front sectional view illustrating a plating apparatus 100A according to a second preferred embodiment of the present invention. As described above, the upper end of the anode 21 is located higher than the liquid level of the plating solution 1, and a portion of the anode 21 located higher than a region where the plating object 2 is plated is covered with a second insulator 90.

The region where the plating object 2 is plated is a region where the plating object 2 accumulates in the plating object passage 23.

Similar to the plating apparatus 100 of the first preferred embodiment, the plating apparatus 100A of the present preferred embodiment also includes the first shielding wall 27 and the second shielding wall 28, which makes it possible to reduce or prevent the bipolar phenomenon from occurring, and thus prevent the reliability of the plated object 2 from being reduced.

The upper end of the anode 21 is located higher than the liquid level of the plating solution 1, and a portion of the anode located higher than a region where the plating object 2 is plated is covered with the second insulator 90, and compared with the configuration without the second insulator 90, it is possible to further reduce the current flowing from the anode 21 to the cathode 26 via the plating solution 1 flowing out of the upper end of the second shielding wall 28, which makes it possible to effectively reduce or prevent the bipolar phenomenon from occurring, and prevent the reliability of the plated object 2 from being reduced.

In the configuration in which the upper end of the anode 21 is located higher than the liquid level of the plating solution 1, the second insulator 90 may not be provided. However, as described above, it is possible to more effectively reduce or prevent the bipolar phenomenon from occurring by covering a portion of the anode 21 located higher than a region where the plating object 2 is plated with the second insulator 90.

The present invention is not limited to the preferred embodiments described above, and various applications and modifications may be made within the scope of the present invention.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A plating apparatus comprising:

a plating tank to store a plating solution; and a plating unit inside the plating tank to perform an electrolytic plating on a plating object; wherein the plating unit includes:

a partition wall which allows the plating solution to pass through but does not allow the plating object to pass through, and defines inside thereof a plating object passage through which the plating object passes downward;

an injector to inject the plating solution upward;

a mixing portion above the injector and below the plating object passage and in which the plating solution injected by the injector and the plating object that has passed through the plating object passage are mixed;

an anode outside the plating object passage;

a cathode inside the plating object passage and including a hollow region through which a fluid mixture of the plating solution and the plating object mixed in the mixing portion flows upward;

a first shielding wall above the cathode and outside the cathode when viewed in the extending direction of the plating object passage to guide the fluid mixture to pass through the hollow region downward; and a second shielding wall outside the first shielding wall;

a lower end of the first shielding wall is lower than an upper end of the second shielding wall; and the first shielding wall does not allow either of the plating solution and the plating object to pass through.

2. The plating apparatus according to claim 1, wherein the upper end of the second shielding wall is higher than a liquid level of the plating solution.

3. The plating apparatus according to claim 1, further comprising a fluid guide to guide the fluid mixture that has passed upward through the hollow region of the cathode to outside when colliding with the fluid guide.

4. The plating apparatus according to claim 3, wherein the fluid guide is above the cathode.

5. The plating apparatus according to claim 1, wherein an upper end of the anode is lower than a liquid level of the plating solution; and the plating apparatus further includes an insulator above the anode so as to cover the anode when viewed from above.

6. The plating apparatus according to claim 1, wherein an upper end of the anode is higher than a liquid level of the plating solution; and a portion of the anode higher than a region where the plating object is plated is covered with an insulator.

7. The plating apparatus according to claim 1, wherein a diameter of an injection port of the injector is smaller than an inner diameter of the cathode.

8. The plating apparatus according to claim 7, wherein the diameter of the injection port of the injector is about 60% or more of the inner diameter of the cathode.

9. The plating apparatus according to claim 1, wherein the partition wall has a cylindrical or substantially cylindrical shape.

10. The plating apparatus according to claim 1, wherein the partition wall is made of a mesh material.

11. The plating apparatus according to claim 1, wherein an upper portion and a lower portion of the partition wall is impermeable to liquid.

* * * * *